United States Patent [19]

Lynn

[11] 4,083,593

[45] Apr. 11, 1978

[54] METHOD AND APPARATUS SUITABLE FOR GRASPING AN ANNULAR WORKPIECE

[75] Inventor: James R. Lynn, Greenville, S.C.

[73] Assignee: Phillips Fibers Corporation, Greenville, S.C.

[21] Appl. No.: 681,359

[22] Filed: Apr. 29, 1976

[51] Int. Cl.[2] ..... B66C 1/42

[52] U.S. Cl. ..... 294/97

[58] Field of Search ..... 294/93, 94, 95, 96, 294/97, 86.24, 86.25, 115, 116; 214/650 R, 620, 652; 29/280

[56] References Cited

U.S. PATENT DOCUMENTS

| | | | |
|---|---|---|---|
| 2,706,658 | 4/1955 | Jewell | 294/97 |
| 3,057,651 | 10/1962 | Lloyd | 294/97 |

*Primary Examiner*—James B. Marbert

[57] ABSTRACT

An annular workpiece is grasped by inserting a wedging member having two ends into the annular portion of the workpiece wherein the wedging member is longer than the diameter of the annular portion of the workpiece and positioning the ends of the wedging member against the inside surface of the annular workpiece.

7 Claims, 5 Drawing Figures

METHOD AND APPARATUS SUITABLE FOR GRASPING AN ANNULAR WORKPIECE

BACKGROUND OF THE INVENTION

The invention relates to a method and apparatus for grasping an annular workpiece. In another aspect the invention relates to a method and apparatus suitable for grasping and repositioning packages of yarn. In another aspect the invention relates to a method and apparatus suitable for use by a workman for moving an annular workpiece without touching the workpiece with his hands.

Frequently it is desirable to move a workpiece, such as a package of yarn, by a workman without his hands touching the workpiece. For example, some packages of yarn are easily damaged when a workman picks it up with his hands if he is not particularly careful. Further, if the workman does not use gloves, oils deposited on the yarn from the workman's hands can adversely affect the yarn, such as by impairing the processability of a freshly spun yarn. This it is desirable to handle an annular workpiece, such as a package of freshly spun yarn, without the necessity of a workman actually touching the workpiece with his hands.

An object of the invention is to grasp an annular workpiece by a workman without the need for the workman to touch the workpiece with his hands.

Another object is to provide an improved apparatus suitable for carrying out the above object.

Other aspects, objects and advantages of the present invention will be apparent to those skilled in the art upon studying the specification, drawings and the appended claims.

SUMMARY OF THE INVENTION

In accordance with the invention an annular workpiece is grasped by inserting a wedging member having first and second ends into the annular portion of the workpiece wherein the length of the wedging member is sufficiently longer than the diameter of the annular portion of the workpiece to wedge therein and positioning the ends of the wedging member against the inside walls of the annular workpiece so that the wedging member is wedged in the annular workpiece.

Further in accordance with the invention apparatus comprises a main support; a lifting member attached to the main support; a wedging member support having a first end and a second end wherein said first end is attached to the main support in a direction opposite the lifting member; a wedging member having a first end and a second end suitable for engaging the inside surface of an annular workpiece, said wedging member having a length sufficiently longer than the diameter of the annular portion of the workpiece to permit the wedging member to wedge therein, said wedging member attached to the wedging member support a distance from the main support in a manner to permit rotation of the wedging member about the point of attachment in a plane perpendicular to the main support, said wedging member having the first end of said wedging member always closer to the main support as compared to the second end; and a releasing means for rotating the wedging member.

BRIEF DESCRIPTION OF THE DRAWINGS

Referring to FIGS. 1 to 3, there is shown a handle 12 in accordance with one embodiment of the invention comprising a lifting member such as the handle 12 having a cross member 12*a* and a shaft 12*b* which is attached to a main support 14. On the opposite side of main support 14 from handle 12, one end of a wedging member support 16 is attached to main support 14 and on the other end of wedging member support 16 is attached wedging member 18 using pin 20 which permits wedging member to rotate about the point of attachment in a plane perpendicular to the main support. Wedging member 18 has two apertures in the surface thereof, 34 and 36. Wedging member support 16 passes through aperture 34 and rod 24 of releasing means 26 passes through aperture 36. Wedging member 18 has beveled ends 38 and 40 which are also curved. Releasing means 22 also has a ring 26 attached to one end of rod 24 adjacent handle 12 to permit "one hand operation". Rod 24 is restricted from passing through aperture 52 in main support 14 by ring 26. A spring 28 is positioned between main support 14 and wedging member 18 ans pushes end 38 of wedging member 18 away from the main support 14. A washer 30 is positioned under spring 28 and wedging member 18 to prevent spring 28 from slipping into aperture 36. Pin 32 in rod 24 keeps washer 30 and spring 28 in place.

Figure 1:
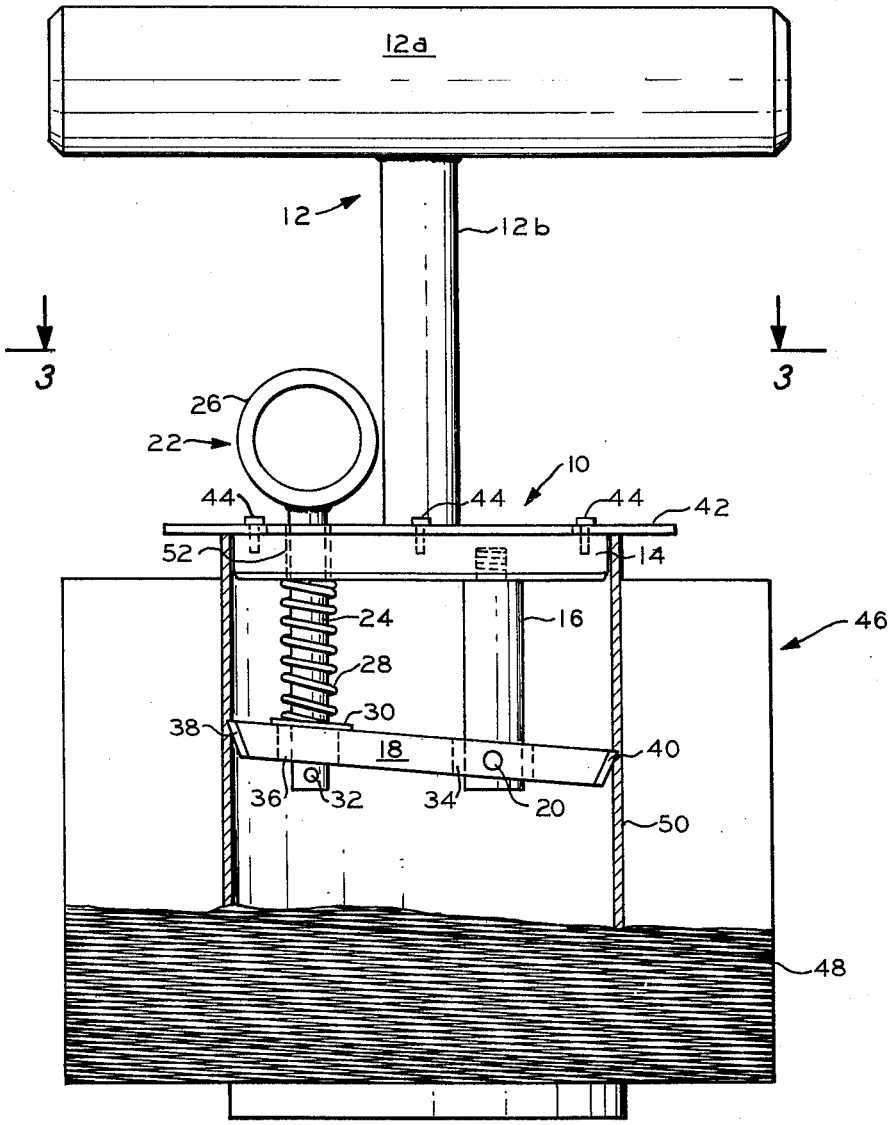
FIG. 1 is a side view of one embodiment of an apparatus in accordance with the invention grasping a package of yarn partially cutaway.

Annular ring 42 is attached to the upper surface of main support 14 using a plurality of screws 44. The annular ring prevents the apparatus from being positioned farther inside the annular workpiece than is desired, but such annular ring is not necessary to practice the invention.

It is important that end 38 of wedging member 18 be closer to main support 14 than end 40 for proper operation of the apparatus. Adjusting the length of wedging member support 16 and the point of attachment of wedging member 18 thereto in relation to the length of rod 24 and the position of pin 32 raises or lowers the relative position of ends 38 and 40.

In the operation of apparatus 10, a workman holding the apparatus by handle 12 slips the apparatus 10 into the annular portion of an annular workpiece, such as the annular portion of yarn package 46 shown in FIG. 1. Yarn package 46 comprises yarn 48 wrapped around a package support 50. Apparatus 10 is slipped into the annular portion of the workpiece up to annular ring 42, if used. Spring 28 pushes down on wedging member 18 which causes ends 38,40 to engage the inside walls of package support 50 and wedge the wedging member therein. The curvature of ends 38,40 increases the surface area of the ends in contact with the inside surface of package support 50, particularly when the radius of curvature of ends 38,40 is approximately the same as the inside surface of the annular portion of the workpiece as compared to square ends. The length of wedging member 18 must be sufficiently longer than the diameter of the annular portion of the workpiece to wedge within the annular portion of the workpiece. The wedging member should also be of a length which will permit the operation of the releasing means to easily release the workpiece. Generally, the length of the wedging member ranges from about 101 to 140 percent longer than the diameter of the annular portion of the workpiece; however the length of the wedging member more often ranges from about 103 to about 120 percent longer than the diameter of the annular portion of the workpiece.

The apparatus 10 is released from the workpiece 46 by pulling rod 24 in the direction of cross member 12*a* of handle 12 which in turn rotates wedging member 18 about pin 20 removing the engagement of ends 38,40 of wedging member 18 with inside walls of package support 50. Ring 26 of releasing means 22 allows the operator to use a finger on the hand-grasping apparatus 10 to provide the upward pressure on rod 24 needed to release the workpiece. Other means can be used in lieu of ring 26 on releasing means 22 to permit "one-handed operation" of the device.

It is emphasized that the present invention finds particular applicability for carrying a workpiece, such as a package of yarn: however, the apparatus can also be used to carry a very large annular workpiece much heavier than a man can carry; thus other lifting members such as hooks or rings can be used to facilitate the use of a hoist or other lifting means. Further, the ends 38,40 of wedging member 18 can be adapted to the type of surface used in the annular portion of the workpiece. For example, the ends 38,40 may be rubber knobs for engaging an inside annular surface such as steel or other metal.

Figure 2:
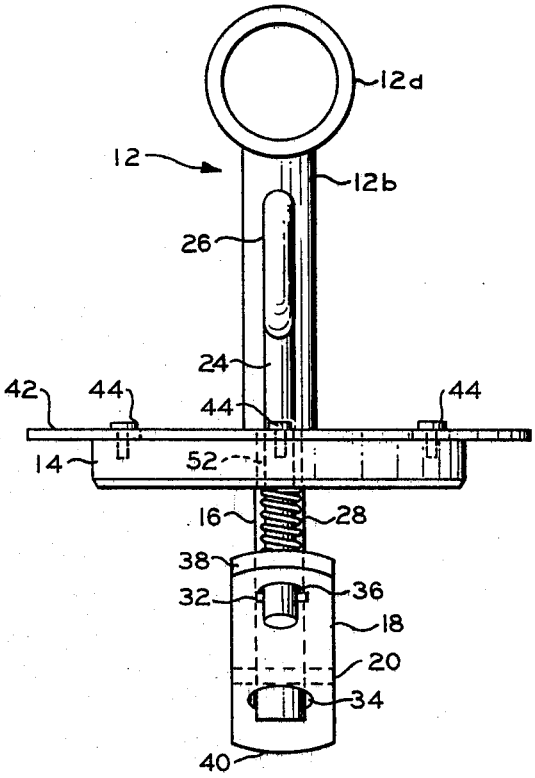
FIG. 2 is a side view of the apparatus of FIG. 1 rotated from left to right 90° without showing the package of yarn.
Figure 3:
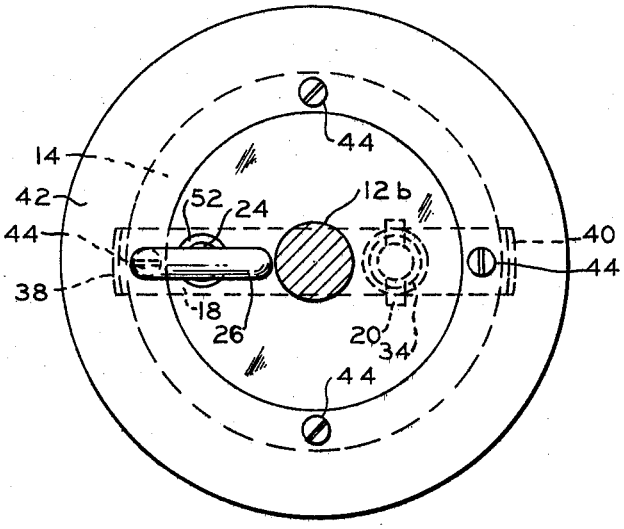
FIG. 3 is a top view of the apparatus of FIGS. 1 and 2 taken along lines 3—3 of FIG. 1 and without showing the package of yarn.
Figure 4:
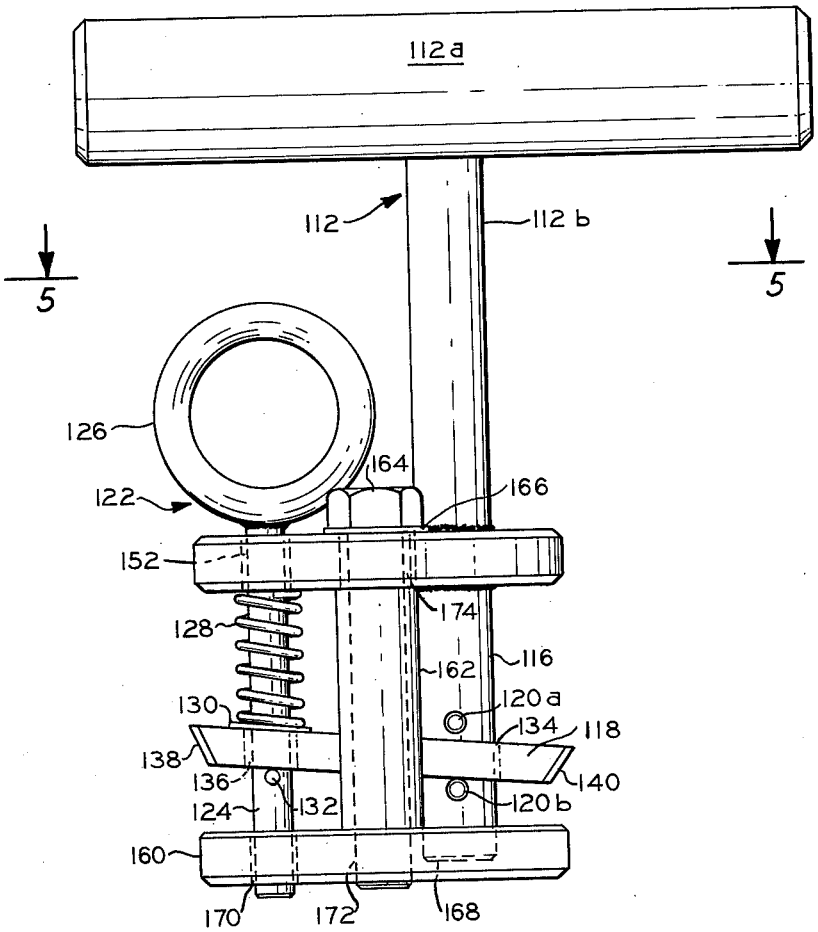
FIG. 4 is a side view of another embodiment of an apparatus in accordance with the invention.
Figure 5:
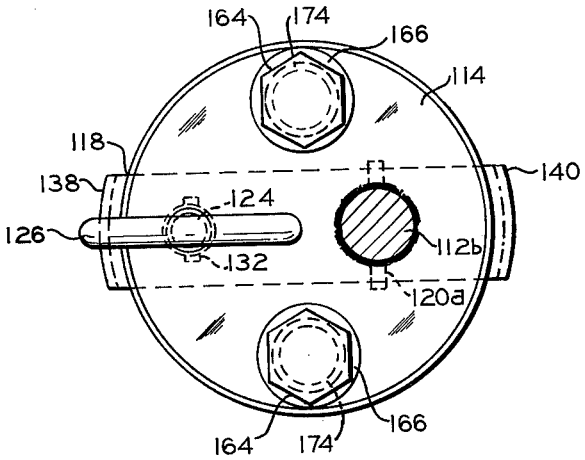
FIG. 5 is a top view of the apparatus of FIG. 4 taken along lines 5—5 of FIG. 4.

In FIGS. 4 and 5 another embodiment of the apparatus of the invention is shown which primarily differs from that of FIGS. 1 to 3 in the use of a secondary support member 160 and spacers 162 which rigidly maintain a specific distance between main support 114 and secondary support 160. In FIGS. 4 and 5 a lifting means, such as handle 112 comprises cross member 112*a* and shaft 112*b* which is also attached to main support 114. Shaft 112*b* passes through main support 114 to form wedging member support 116 which than extends through aperture 134 in wedging member 118 to secondary support 160. Pins 120*a* and 120*b* are attached to wedging member support 116 above and below wedging member 118, respectively. If desired one pin could be used to attach wedging member 118 to support 116 as in FIGS. 1 to 3. Wedging member 118 has two beveled ends 138 and 140 which are curved to better wedge against the inside surface of the annular portion of the workpiece as previously described for the apparatus in FIGS. 1 to 3. The distance between main support 114 and secondary support 160 is maintained by at least one spacer. In FIGS. 4 and 5 two spacers 162 are used along with bolt 164 and lock washer 166. The bolt 164 passes through apertures 174 in main support 114, spacers 162 and screwed into threaded apertures 172 in secondary support 160.

Releasing means 122 comprises ring 126 attached to one end of rod 124 which passes through aperture 152 in main support 114, spring 128 and washer 130, aperture 136 in wedging member 18, and aperture 170 in secondary support 160. Pin 132 is attached to rod 124 to position end 138 of wedging member 118 closer to main support 114 than end of wedging member 118.

In the operation of the apparatus shown in FIGS. 4 and 5, the device is inserted into the annular portion of an annular workpiece, inserting the secondary support end into the annular portion first, until the sides of the main support are inside the annular portion of the workpiece. Spring 128 applies sufficient downward force upon wedging member 118 which positions the ends 138,140 against the inside surface of the annular portion of the workpiece to prohibit removal of the device from the annular portion which has now grasped the workpiece. The device is easily removed from the workpiece by pulling releasing means 122 and particularly rod 124 and pin 132 toward the cross member 112a to rotate wedging member so as to move end 138 toward main support 114 and end 140 toward secondary support 160. When end 138 is no longer in contact with the inside surface of the annular portion of the workpiece the device is removed therefrom.

EXAMPLE

An apparatus of the invention as shown in FIG. 4 was constructed from aluminum except as noted in which the main support was 0.38 inche plate (0.965 cm) cut in the shape of a circle 2.44 inches (6.2 cm) in diameter. The spacer holes were smooth bore, 0.391 inches (0.992 cm) in diameter spaced on a center line 0.97 inches (2.463 cm) from the center. The hole for the shaft of the handle was 0.515 inches (1.309 cm) on a center line 90° from the center line for the spacer holes, 0.5 inches (1.27 cm) from the center, and the hole for the releasing means was 0.265 inches (0.673 cm) in diameter on the same center line as the shaft hole, 0.75 inches (1.90 cm) from the center. The secondary support was identical to the main support except that the holes for the spacer were threaded with 16 NC threads using 0.375 inches (0.952 cm) diameter holes. The hole for receiving the wedging member support (handle shaft) was drilled approximately halfway through the secondary support plate. The spacers were 1.675 inches (4.13 cm) long which determined the distance between the main support and the secondary support. The two pins in the wedging support member were spaced 0.5 inches (1.27 cm) and 0.94 inches (2.38 cm) respectively from the top of the secondary support. The two pins were steel 0.125 inches (0.317 cm) in diameter 1 inches (2.54 cm) long. The cross member of the handle was 5.0 inches (12.7 cm) long 0.750 inches (1.90 cm) diameter tubing. The shaft was 0.5 inches (1.27 cm) tubing, 4.750 inches (12.065 cm) long and welded to the main support and the cross member. The wedging member was 0.250 inches (0.635 cm) thick plate, 1 inches (2.54 cm) wide and 2.56 inches (6.50 cm) long. The hole for the wedging member support was 0.562 inches (1.429 cm) in diameter along the center line 0.530 inches (1.35 cm) from the center and the hole for the releasing means rod was 0.375 inches (0.952 cm) in diameter along the center line 0.780 inches (1.980 cm) from the center. Both holes were counterscnk on both edges. The ends of the wedging member had a circular contour on a radius of 1.280 inches (3.25 cm) and were beveled on 30° slanting toward the center beginning on the top surface of the wedging member. The ring of the releasing means has a 1 inch (2.54 cm) inside diameter and was made from 0.25 inches (0.317 cm) diameter rod. The rod of the releasing means was 2.50 inches (0.635 cm) diameter rod 2.50 inches (6.35 cm) long. A pin 0.093 inches (0.24 cm)

in diameter, 0.075 inches (0.19 cm) long was positioned 0.750 inches (1.90 cm) from the bottom of the rod. A spring with 1 inch (2.54 cm) free length, 0.36 inches (0.914 cm) outside diameter made of 0.026 inches (0.066 cm) diameter wire and having 4.1 lb./in. spring rate was used. The apparatus was used to grasp yarn packages having a package support with an inside diameter of 2.52 inches (6.4 cm). The apparatus easily grasped the packages and easily released them by operating the releasing means, thus providing "one-handed operation" without the necessity of the operator's hands touching the yarn.

What is claimed is:

1. Apparatus comprising:

a main support having a first surface and a second surface;

a lifting member attached to the first surface of the main support;

a wedging member support having a first end and a second end wherein said first end is attached to the second surface of the main support;

a wedging member having a first end and a second end, said first and second ends of the wedging member suitable for engaging the inside surface of an annular workpiece, said wedging member having a length sufficiently longer than the inside diameter of the annular portion of the workpiece to permit the wedging member to wedge therein, said wedging member being attached to the wedging member support a distance from the main support in a manner to permit rotation of the wedging member about the point of attachment in a plane perpendicular to the main support and said wedging member having the first end of said wedging member always closer to the main support as compared to the second end of said wedging member; and a releasing means for rotating the wedging member.

2. The apparatus of claim 1 wherein said wedging member has a first surface and a second surface, the first surface being adjacent the main support, the ends of said wedging member being tapered outwardly from the second surface to the first surface, the first and second surfaces of said wedging member having a aperture therein through which the wedging member support passes, and the wedging member being attached to said support by pins attached to said support intermediate the surfaces of said wedging member.

3. The apparatus of claim 1 wherein the length of the wedging member ranges from about 101 to about 140 percent longer than the inside diameter of the annular portion of the annular workpiece.

4. The apparatus of claim 1 wherein the length of the wedging member ranges from about 103 to about 120 percent longer than the inside diameter of the annular portion of the annular workpiece.

5. Apparatus comprising:

a main support having first and second surfaces;

a lifting member attached to the main support;

a wedging member support having a first end and a second end wherein said first end is attached to the second surface of the main support;

a wedging member having a first end and a second end, said first and second ends of said wedging member being suitable for engaging the inside surface of an annular workpiece, said wedging member having a length sufficiently longer than the inside diameter of the annular portion of the workpiece to permit the wedging member to wedge therein, said wedging member being attached to the wedging member support a distance from the main support in a manner to permit rotation of the wedging member about the point of attachment in a plane perpendicular to the main support and said wedging member having the first end of said wedging member always closer to the main support as compared to the second end of said wedging member, said wedging member having a first surface and a second surface, the first surface being adjacent the main support, the ends of said wedging member being tapered outwardly from the second surface to the first surface, the surfaces having an aperture therein through which the wedging member support passes, and the wedging member being attached to said support by pins attached to said support adjacent the surfaces of said wedging member; and releasing means for rotating the wedging member comprising a rod passing through the main support and through a second aperture in the wedging member, a pin positioned in said rod adjacent the second surface of said wedging member and a spring positioned between the main support and the wedging member so that the first end of said wedging member is pushed away from the main support.

6. The apparatus of claim 5 further comprising a second support adjacent to and spaced a distance from the second surface of the wedging member and parallel to the main support, connected to the second end of the wedging member support, and having an aperture therein through which said rod passes.

7. The apparatus of claim 6 wherein the lifting support is a handle comprising a shaft and a cross member and the shaft extends through the main support to form the wedging member support, at least one spacer is positioned between and attached to the main support and the second support, the main support and the second support are circular and have concentric centers, the rod has a ring attached to the end thereof adjacent the handle, the spring is positioned on the rod, and the annular workpiece is a package of yarn.

* * * * *